US010775100B2

(12) United States Patent
Signorino et al.

(10) Patent No.: US 10,775,100 B2
(45) Date of Patent: Sep. 15, 2020

(54) DOMESTIC COOLING DEVICE HAVING A WALL LIGHT, AND METHOD FOR PRODUCING THE COOLING DEVICE

(71) Applicant: emz-Hanauer GmbH & Co. KGaA, Nabburg (DE)

(72) Inventors: Manfredi Signorino, Wackersdorf (DE); Martin Brabec, Nabburg (DE); Franz Forster, Altfalter (DE)

( * ) Notice: Subject to any disclaimer, the term of this patent is extended or adjusted under 35 U.S.C. 154(b) by 0 days.

(21) Appl. No.: 16/396,813

(22) Filed: Apr. 29, 2019

(65) Prior Publication Data

US 2019/0339003 A1 Nov. 7, 2019

(30) Foreign Application Priority Data

May 3, 2018 (DE) ..... 10 2018 003 587

(51) Int. Cl.

| | |
|---|---|
| ***F21V 33/00*** | (2006.01) |
| ***F25D 27/00*** | (2006.01) |
| ***F25D 23/06*** | (2006.01) |
| ***F21K 9/66*** | (2016.01) |
| ***F21K 9/68*** | (2016.01) |
| *F21Y 115/10* | (2016.01) |

(52) U.S. Cl.

CPC ..... *F25D 27/00* (2013.01); *F21K 9/66* (2016.08); *F21K 9/68* (2016.08); *F25D 23/06* (2013.01); *F21Y 2115/10* (2016.08); *F25D 2201/10* (2013.01)

(58) Field of Classification Search

CPC ..... F25D 27/00; F25D 27/005

See application file for complete search history.

(56) References Cited

U.S. PATENT DOCUMENTS

| | | | |
|---|---|---|---|
| 8,459,818 | B2 | 6/2013 | Becke et al. |
| 2013/0027906 | A1 | 1/2013 | Ueda et al. |

(Continued)

FOREIGN PATENT DOCUMENTS

| | | | |
|---|---|---|---|
| DE | 10 2005 021 562 | A1 | 11/2006 |
| DE | 102008044302 | A1 | 6/2010 |

(Continued)

OTHER PUBLICATIONS

German search results in priority application DE 10 2018 003 587.6, dated Jul. 12, 2018.

*Primary Examiner* — Matthew J. Peerce

(74) *Attorney, Agent, or Firm* — Sarita Pickett; Robert Deleault

(57) ABSTRACT

A domestic cooling device includes an insulating wall, a cold chamber adjoining the insulating wall, and a wall light arranged on the insulating wall. The wall light includes at least one light source, a window element which forms a transparent window region, and a reflection surface that is arranged in front of the window element in the propagation path of at least a portion of the light radiation coming from the light source. The insulating wall includes an inner lining part adjoining the cold chamber and an insulating foam material arranged behind the inner lining part. An opening is formed in the inner lining part, at least a portion of the reflection surface being arranged within the contour of the opening. At least a portion of the reflection surface is formed by a cover part that covers the opening and with which the insulating foam material is in contact.

16 Claims, 4 Drawing Sheets

(56) References Cited

U.S. PATENT DOCUMENTS

| | | | | |
|---|---|---|---|---|
| 2013/0207527 | A1 | 8/2013 | Heinrich et al. | |
| 2019/0017679 | A1* | 1/2019 | Choi | F21V 7/28 |

FOREIGN PATENT DOCUMENTS

| | | | |
|---|---|---|---|
| DE | 102012223842 | A1 | 6/2014 |
| EP | 1887298 | B1 | 2/2008 |
| EP | 2444764 | A1 | 4/2012 |
| JP | 2008070080 | A1 | 3/2008 |
| JP | 2014-156983 | | 8/2014 |

* cited by examiner

DOMESTIC COOLING DEVICE HAVING A WALL LIGHT, AND METHOD FOR PRODUCING THE COOLING DEVICE

BACKGROUND OF THE INVENTION

1. Field of the Invention

The present invention relates generally to a domestic cooling device which is equipped with a wall light for illuminating a cold chamber of the domestic cooling device.

2. Description of the Prior Art

Domestic refrigerators are typically provided with one or more lights, the purpose of which is to light a cold chamber of the refrigerator when the refrigerator door is open, so that the user has a better view of the foods stored in the cold chamber. A type of light that is conventionally used is a wall light, which is mounted on an insulating wall, adjoining the cold chamber, of an insulating housing of the refrigerator.

SUMMARY OF THE INVENTION

An object of the invention is to show a way in which, in a domestic cooling device, a wall light can be produced in a structurally simple manner and with low production costs.

In order to achieve that object there is provided a domestic cooling device which comprises an insulating wall, a cold chamber adjoining the insulating wall, and a wall light arranged on the insulating wall for illuminating the cold chamber. The wall light comprises at least one light source, in particular of the LED type, a window element which forms a transparent window region through which light generated by the wall light emerges into the cold chamber, and a reflection surface, in particular having a diffusely reflecting action, which is arranged in front of the window element in the propagation path of at least a portion of the light radiation coming from the light source. The insulating wall comprises an inner lining part adjoining the cold chamber and an insulating foam material arranged behind the inner lining part. An opening is formed in the inner lining part, at least a portion of the reflection surface being arranged within the contour of the opening. According to the invention, at least a portion of the reflection surface is formed by a cover part which covers the opening and with which the insulating foam material is in contact. In particular, the reflection surface can be formed wholly by the cover part.

Particular embodiments of the invention are based on the idea of using a component that is conventionally employed in the production of the insulating wall, namely in the filling of a space situated behind the inner lining part with an insulating foam material, also to form the reflection surface of the wall light. In order to prevent the insulating foam material from escaping from the insulating wall through the opening during the foaming operation, a cover part which covers the opening is conventionally fixed to the inner lining part. According to the invention, such a cover part can serve as the reflector of the wall light. A separate, additional reflector is therefore unnecessary. This reduces the total number of components required and has an advantageous effect on the production costs of the wall light and of the cooling device as a whole. The cover part is, for example, a plastics component which, where it forms the reflection surface, can be designed with the surface condition required for the desired reflection behaviour. If the reflection surface (or at least a part-region thereof) is to have a scattering action, the cover part can be designed, for example, with a suitably matt appearance or/and a suitable surface roughness in the (part-)region of reflection surface.

In particular embodiments, the cover part is attached to the inner lining part from the side of the inner lining part that is remote from the cold chamber. The cover part can extend beyond the opening all round on the side of the inner lining part that is remote from the cold chamber. For example, the cover part can be fixed to the inner lining part by adhesive bonding means. The adhesive bonding means can comprise an adhesive by means of which the cover part is adhesively bonded directly to the inner lining part. Alternatively or in addition, the adhesive bonding means can comprise a tape material that is adhesive on one side or on both sides, by means of which it is possible to fix the cover part to the inner lining part.

In particular embodiments, the cover part forms a hollow, wherein at least a portion of the reflection surface, in particular substantially the entire reflection surface, is arranged in the hollow. By using techniques of injection moulding or deep drawing, there is wide scope in the configuration of the shape of the hollow.

In particular embodiments, the window region extends over at least a portion of the hollow. In order that the wall light protrudes only slightly from the inner lining part, it is advantageous if the light source and/or a circuit board on which the light source is mounted is arranged so that it is recessed at least in part, in particular substantially completely, in the hollow.

In particular embodiments, the hollow is in the form of a groove, wherein, when viewed in the groove cross-section, it has two opposite flank regions of different flank steepness. The light source can be arranged closer to the steeper of the two flank regions. If a plurality of light sources are present, they are arranged in a row spaced apart one behind the other in the longitudinal direction of the groove.

In particular embodiments, the light source and the window element are part of a preassembled light subassembly which is connected, in particular releasably connected, to the cover part from the side of the inner lining part that faces the cold chamber. The cover part itself is not part of the light subassembly; only when the light subassembly is attached to the inner lining part from the side thereof that faces the cold chamber does the cover part come into engagement with the light subassembly and be connected thereto. For example, the light subassembly or/and the cover part can be designed with at least one locking hook which engages behind a locking shoulder formed on the respective other component of the light subassembly and the cover part.

In particular embodiments, the wall light has a frame region which extends all round the window region and has a visible surface, facing towards the cold chamber, which contrasts visually with the window region, wherein the window region and the frame region are formed integrally in one piece and the frame region is formed of a different-coloured material to the window region or/and the visible surface has a different surface condition to the window region. Such an integral one-piece form of the window region and the frame region is also considered to be patentable on its own, independently of the use of the cover part as the reflector of the wall light. For example, the frame region and the window region can be manufactured from the same transparent plastics material, wherein the resulting plastics body is surface-treated, for example roughened, in the region of the visible surface in order to reduce or even completely eliminate the transparency in the region of the visible surface.

In particular embodiments, the wall light comprises a first light part which comprises at least the window element, in particular also the light source, and a second light part which is structurally separate from the first light part and forms at least a portion of the reflection surface. The second light part extends beyond the opening on the side of the inner lining part that is remote from the cold chamber, in particular all round. The first light part and the second light part are designed with cooperating connecting structures, which allow the two light parts to be releasably connected, for example interlocked, by attachment of the first light part to the second light part from the side of the inner lining part that faces the cold chamber. This aspect too, which is based on attaching the two light parts to the inner lining part not from the same side (namely the side that faces the cold chamber) of the inner lining part but from opposite sides of the inner lining part, is considered to be patentable on its own, independently of the use of the cover part as the reflector of the wall light.

The invention further provides a method which is used in the production of a domestic cooling device, in particular of a cooling device of the type described hereinbefore. The method comprises the steps: providing an inner lining part provided with an opening, a cover part, and a preassembled light subassembly which is separate from the cover part and comprises at least one light source and also a window element forming a transparent window region; fixing the cover part to a first side of the inner lining part so that the cover part covers the opening; attaching the light subassembly to the inner lining part from an opposite second side of the inner lining part in order to bring the light subassembly into holding engagement, in particular releasable holding engagement, with the cover part; and filling a space situated on the first side of the inner lining part with an insulating foam material so that the insulating foam material is in contact with the cover part.

The invention will be explained further hereinbelow with reference to the accompanying drawings.

DETAILED DESCRIPTION OF THE INVENTION

Figure 1:
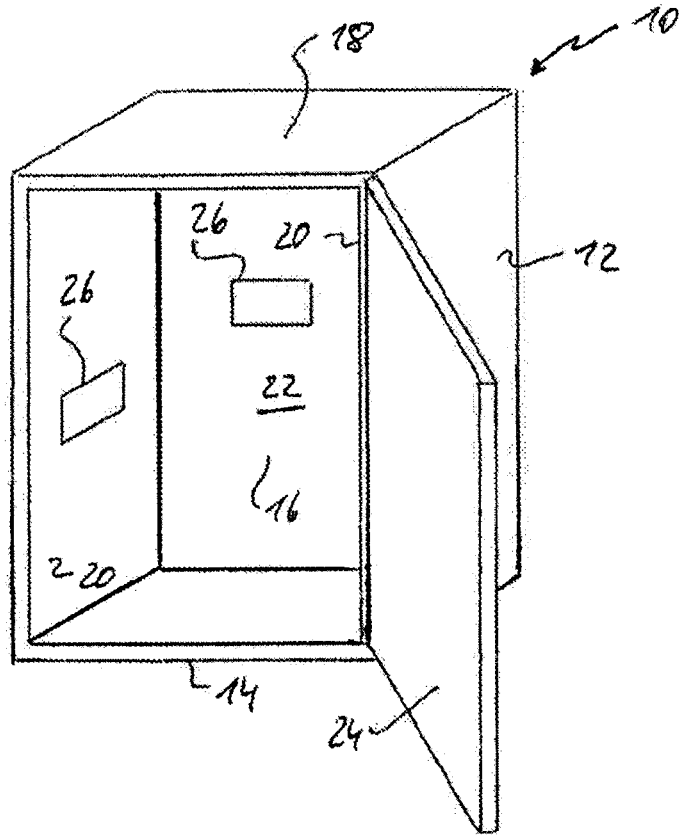
FIG. 1 shows, schematically, a domestic cooling device according to a first exemplary embodiment.

Reference will first be made to FIG. 1. The cooling device shown therein, which is intended for use in a private household, is designated generally 10. The cooling device 10 serves for keeping foods cold above or/and below the freezing point. In the example shown, it is in the form of a cabinet and comprises a main housing 12 having a bottom wall 14, a rear wall 16, a top wall 18 and two mutually opposite side walls 20, which together delimit a cold chamber 22 of the cooling device 10. The cold chamber 22 can be equipped, in a manner which is not shown in detail but is generally known, with various built-in parts, for example shelves and drawers, which serve for storing the foods to be kept in the cooling device 10. A door 24 by means of which the cold chamber 22 can be closed is pivotably mounted on the main housing 12.

When the door 24 is open (as shown in FIG. 1), it is desirable to illuminate the cold chamber 22 artificially, in order to provide the user with a better view of the foods therein. For this purpose, at least one wall light 26 is arranged on at least one of the walls 14, 16, 18, 20, which wall light is so controlled that it is switched on and off depending on the opening and closing of the door 24. In the example shown, one wall light 26 is arranged on the rear wall 16 and a further wall light 26 is arranged on the side wall 20 on the left in the representation of FIG. 1. It will be appreciated that the distribution pattern of the wall lights 26 shown in FIG. 1 is purely by way of example and can be changed as desired in terms of both the number and the position of the wall lights 26. It will additionally be appreciated that the wall lights 26 do not have to be the only lighting means with which the cooling device 10 is equipped. In addition to the wall lights 26, lighting means of different forms can be provided. Such different types of lighting means are not subject-matter of the present disclosure and require no further explanation.

Figure 2:
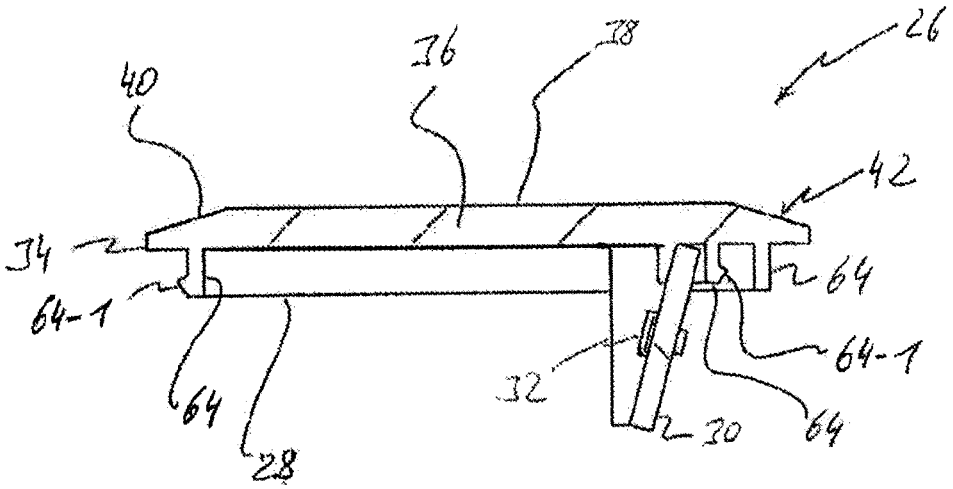
FIG. 2 shows a light subassembly and a cover part as components of a wall light of the cooling device of FIG. 1.
Figure 2:
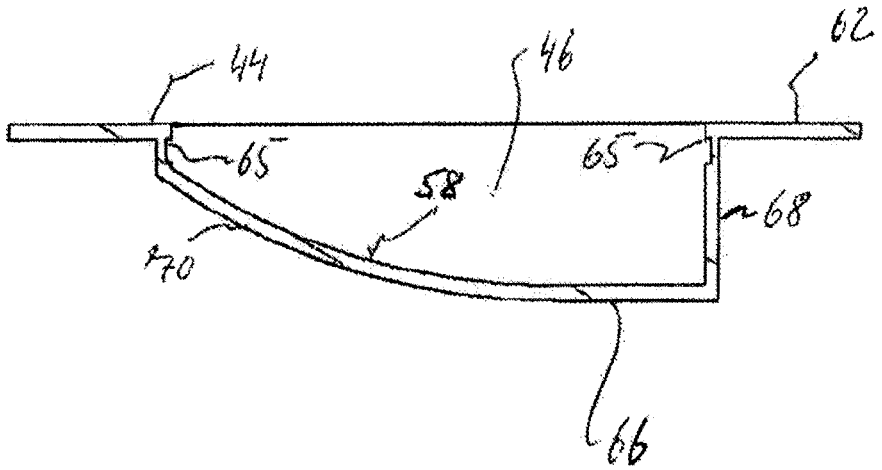
Figure 3:
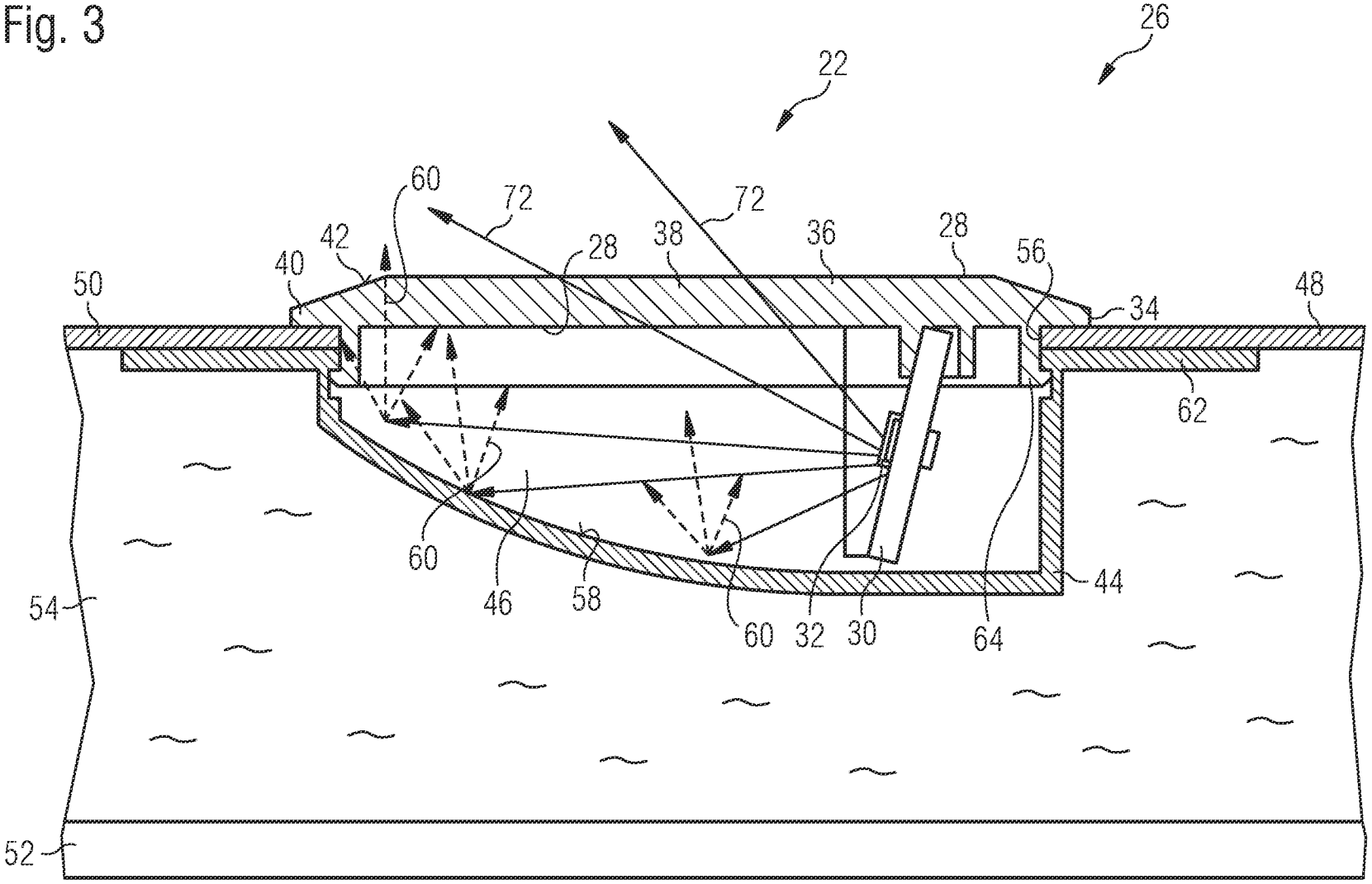
FIG. 3 shows the wall light having the components of FIG. 2 in a final mounted state.
Figure 3A:
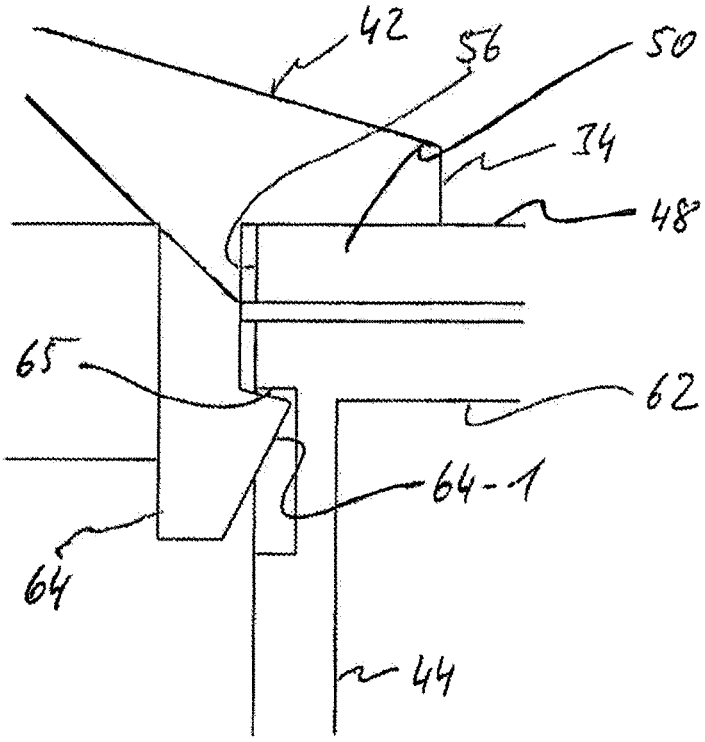
FIG. 3*a* shows an enlarged detail of FIG. 3.

For further details of the wall lights 26, reference will now additionally be made to FIGS. 2, 3 and 3*a*, which are sectional representations of one of the wall lights 26, on the one hand broken down into individual components (FIG. 2) and on the other hand in the final mounted state (FIGS. 3 and 3*a*). According to the exemplary embodiment of FIGS. 2, 3 and 3*a*, the wall light 26 comprises a light subassembly 28 which can be preassembled, which is also referred to hereinbelow as a lighting module. The lighting module 28 forms a first light part within the meaning of the invention and comprises a plurality of light sources 32 (e.g. white-light LEDs) arranged in a row spaced apart one behind the other on a circuit board 30, and a module body 34 to which the circuit board 30 is releasably or permanently fixed, for example by a snap-action connection or a press-fit connection. The row of light sources 32 extends perpendicularly to the plane of the drawing of FIGS. 2 and 3. The module body 34 forms a plate- or disc-like window element 36 made of a transparent material. The window element 36 in turn forms a window region 38, within which light from the wall light 26 is able to emerge. The window region 38 is surrounded all round by a frame region 40, in which the module body 34 forms a visible surface 42 which contrasts visually with the window region 38. The visible surface 42 extends all round the window region 38 and, from the point of view of the user, represents an outside border of the window region 38. This ensures an aesthetically pleasing design of the wall light 26. In the example shown, the module body 34 is a one-piece component which comprises both the window region 38 and the frame region 40. In the window region 38, the module body 34 can be, for example, in the form of a transparent body with a transmission of 90% or 95% or more for visible light. Alternatively, the module body 34 can have a milky (opaque) appearance in the window region 38.

In the frame region 40, the module body 34 can consist of the same material as in the window region 38, whereby, in order to achieve the desired visual contrast between the visible surface 42 and the window region 38, the visible surface 42 can have been subjected to a surface treatment. The surface treatment can comprise, for example, a coating with a coloured lacquer or with a coating having a metallic appearance (galvanisation). Alternatively, the frame region 40 can have been subjected to roughening of its surface in the region of the visible surface 42 so that the transparency in that region is reduced or even eliminated completely as compared with the window region 38.

Another possibility consists in producing the module body 34 from plastics materials of different kinds in a multi-component injection-moulding process, a transparent plastics material being used for the window region 38 and a non-transparent plastics material being used for the frame region 40 and any other regions of the module body 34.

A further component of the wall light 26 is a cover part 44, which is separate from the lighting module 34 and forms a hollow 46 in which the circuit board 30 with the light sources 32 mounted thereon is received when the wall light 26 is assembled. In the final mounted state, the wall light 26 is arranged on an insulating wall 48 (FIG. 3), which is one of the walls 14, 16, 18, 20 which delimit the cold chamber 22 of the cooling device 10 of FIG. 1. For example, the insulating wall 48 is the rear wall 16 or one of the side walls 20. The insulating wall 48 is of multi-layer construction and comprises an inner lining part 50, an outer lining part 52 and an insulating foam material 54 which fills a space between the inner lining part 50 and the outer lining part 52 and is the result of a foaming operation in which the mentioned space is filled with foam by means of a suitable, often liquid starting product. The cover part 44, which can also be referred to as a cover cap, has a dual function. It serves to cover an opening 56 formed in the inner lining part 50 during the foaming operation so that no insulating foam escapes from the insulating wall 48 through the opening 56. In addition, the cover part 44 forms a reflection surface 58 of the wall light 26, which is irradiated by at least a portion of the light radiation generated by the light sources 32 and effects diffuse reflection (scattering) of that light radiation. This scattering action is illustrated graphically in FIG. 3 by broken arrows 60.

The cover part 44 forms a second light part within the meaning of the invention and has an edge portion 62 running all round the opening 56, with which the cover part 44 is attached to the inner lining part 50 on the side thereof that is remote from the cold chamber. In this manner, the opening 56 is covered completely by the cover part and closed. The surfaces at which the edge portion 62 and the inner lining part 50 are in contact with one another can be provided with an adhesive in order to fix the cover part 44 to the inner lining part 50. Alternatively or in addition, adhesive strips of tape material can be used for fixing the cover part 44 to the inner lining part 50. In the subsequent final mounted state, it is not possible to remove the cover part 44 from the cold chamber 22 without damaging the wall light 26. Only the lighting module 28 can be removed from the cold chamber 22, for example in order to allow the circuit board 30 to be replaced if one or more of the light sources 32 mounted thereon have failed.

An arrangement of one or more locking hooks 64 is formed on the module body 34 or/and on the cover part 44. In the example shown, a plurality of such locking hooks 64 are formed on the module body 34. Each locking hook has a hook nose 64-1 with which the locking hook 64 in question snaps behind a locking shoulder 65 (see in particular FIGS. 2 and 3*a*) formed on the cover part 44 when the wall light 26 is assembled (i.e. when the lighting module 28 is attached to the inner lining part 50 from the side of the cold chamber 22) and thereby connects the lighting module 28 to the cover part 44. The locking connection between the lighting module 28 and the cover part 44 can be releasable so that, if required, for example if one of the light sources 32 fails, the lighting module 28 can be removed from the cover part 44 and thus from the insulating wall 48 and the faulty light source 32 can be replaced. Each locking hook 64 is, for example, in the form of a flexibly deflectable locking tongue which, when the lighting module 28 and the cover part 44 are fitted together, first deflects resiliently before the hook nose 64-1 snaps behind the locking shoulder 65. It will be recognised that, when the wall light 26 is mounted, the frame region 40 of the module body 34 comes to lie on the side of the inner lining part 50 that faces the cold chamber so that, in the final mounted state, the inner lining part 50 is enclosed between the edge portion 62 of the cover part 44 and the edge region 40 of the module body 34. The locking connecting means (i.e. the locking hooks 64 engaging behind the locking shoulder(s) 65) acting between the module body 34 and the cover part 44 are in particular in such a form that the inner lining part 50 is clamped under pressure between the frame region 40 and the edge portion 62.

During production of the refrigerator 26, the space between the inner lining part 50 and the outer lining part 52 is only filled with foam once the cover part 44 has been positioned over the opening 56 on the inner lining part 50 and fixed thereto. The lighting module 28 can likewise be inserted into the opening 26 and connected to the cover part 44 before the foaming operation. It is, however, also possible to mount the lighting module 28 on the insulating wall 48 only after the foaming operation. The insulating foam material 54 reaches right up to the cover part 44 and covers it substantially completely on the side of the cover part 44 that is remote from the cold chamber 22.

The hollow 46 of the cover part 44 is in the form of a groove-like depression which has a substantially constant groove cross-section in the groove longitudinal direction and, when viewed in the groove cross-section (according to the representation of FIGS. 2 and 3), has a groove bottom 66 and two groove flanks 68, 70 laterally adjoining the groove bottom 66. The groove flank 68 is considerably steeper than the groove flank 70 and, in the example shown in FIGS. 2 and 3, extends substantially perpendicularly to the wall plane of the insulating wall 48. The groove flank 70, on the other hand, follows a path which at least for the large part is curved in an arcuate manner. The row of light sources 32 extends in the groove longitudinal direction of the hollow 46, the light sources 32 being arranged closer to the steeper groove flank 68 than the groove flank 70. The reflection surface 58 is formed in the region of the groove bottom 66 and the groove flank 70.

The circuit board 30 is so oriented that a portion of the light radiation emitted by the light sources 32 first strikes the reflection surface 58, where it is scattered. Only then does the resulting scattered radiation (represented by the arrows 60) leave the wall light 26 through the window region 38. Another portion of the light radiation emitted by the light sources 32 strikes the window region 38 directly, as is illustrated in FIG. 3 by two solid arrows 72. This portion of the light radiation, depending on the angle of incidence, can leave the wall light 26 directly through the window region 38, or it may undergo total reflection at the side of the window element 36 that is remote from the cold chamber and be reflected back in the direction towards the reflection surface 58, where it is scattered.

Because the reflection surface 58 is provided directly on the cover part 44, the wall light 26 does not require a separate reflector body, which would have to be provided in addition to the cover part 44. This lowers the outlay for the wall light 26 in terms of components and reduces the production costs thereof.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A domestic cooling device comprising:

an insulating wall;

a cold chamber adjoining the insulating wall; and a wall light arranged on the insulating wall for illuminating the cold chamber, wherein the wall light comprises; at least one light source;

a module body having a window element which forms a transparent window region through which light generated by the light source emerges into the cold chamber; and a reflection surface having a diffusely reflecting action, which is arranged in front of the window element in the propagation path of at least a portion of the light radiation coming from the light source;

wherein the insulating wall comprises an inner lining part adjoining the cold chamber and an insulating foam material arranged behind the inner lining part;

wherein an opening is formed in the inner lining part and at least a portion of the reflection surface is arranged within the contour of the opening;

wherein at least a portion of the reflection surface is formed by a cover part which covers the opening and with which the insulating foam material is in contact;

wherein the cover part forms a hollow and at least a portion of the reflection surface is arranged in the hollow;

wherein the module body completely covers the hollow;

wherein the wall light has a frame region which extends all around the window region and has a visible surface, facing towards the cold chamber, which contrasts visually with the new window region, wherein the window region and the frame region are formed integrally in one piece and the frame region is formed of a different-coloured material to the window region or the visible surface has a different surface condition to the window region or both; and wherein the module body clamps together portions of the inner lining part and the cover part.

2. The domestic cooling device according to claim 1, wherein the cover part is attached to the inner lining part from the side of the inner lining part that is remote from the cold chamber.

3. The domestic cooling device according to claim 1, wherein the cover part extends beyond the opening all round on the side of the inner lining part that is remote from the cold chamber.

4. The domestic cooling device according to claim 1, wherein the cover part is fixed to the inner lining part by adhesive bonding means.

5. The domestic cooling device according to claim 1, wherein the window region extends over at least a portion of the hollow.

6. The domestic cooling device according to claim 1, wherein the light source or/and a circuit board on which the light source is mounted is arranged so that it is recessed at least in part in the hollow.

7. The domestic cooling device according to claim 1, wherein the hollow is in the form of a groove and, when viewed in the groove cross-section, has two opposite flank regions of different flank steepness, wherein the light source is arranged closer to the steeper of the two flank regions.

8. The domestic cooling device according to claim 1, wherein the light source and the window element are part of a preassembled light subassembly which is connected to the cover part from the side of the inner lining part that faces the cold chamber.

9. The domestic cooling device according to claim 8, wherein the light subassembly or/and the cover part is designed with at least one locking hook which engages behind a locking shoulder formed on the respective other component of the light subassembly and the cover part.

10. The domestic cooling device according to claim 1, comprising a first light part which comprises at least the window element, the light source, and a second light part which is structurally separate from the first light part and forms at least a portion of the reflection surface, wherein the second light part extends beyond the opening on the side of the inner lining part that is remote from the cold chamber, in particular all around, and the first light part and the second light part are designed with cooperating connecting structures which allow the two light parts to be releasably connected by attachment of the first light part to the second light part from the side of the inner lining part that faces the cold chamber.

11. The domestic cooling device according to claim 1, wherein the at least one light source is an LED.

12. The domestic cooling device according to claim 1, wherein the light source or/and a circuit board on which the light source is mounted is arranged so that it is recessed substantially completely in the hollow.

13. The domestic cooling device according to claim 1, wherein the light source and the window element are part of a preassembled light subassembly which is releasably connected to the cover part from the side of the inner lining part that faces the cold chamber.

14. The domestic cooling device according to claim 1, wherein the module body having the window element further comprises a frame region which extends all around the window element, and a locking connecting means adjacent the frame region; wherein the window element, the frame region, and the locking connecting means are integrally formed in one piece.

15. The domestic cooling device according to claim 14, wherein the locking connecting means being formed of a plurality of locking hooks which secure together portions of the inner lining part and the cover part.

16. A domestic cooling device comprising:

an insulating wall;

a cold chamber adjoining the insulating wall; and a wall light arranged on the insulating wall for illuminating the cold chamber, wherein the wall light comprises: at least one light source;

a module body having a window element and a frame region, the frame region surrounding the window element, wherein the window element forms a transparent window region through which light generated by the light source emerges into the cold chamber, wherein the frame region contrasts visually with the window region and the window region and the frame region are formed integrally in one piece and the frame region is formed of a different-coloured material to the window region or the visible surface has a different surface condition to the window region or both; and a reflection surface having a diffusely reflecting action, which is arranged in front of the window element in the propagation path of at least a portion of the light radiation coming from the light source;

wherein the insulating wall comprises an inner lining part adjoining the cold chamber and an insulating foam material arranged behind the inner lining part;

wherein an opening is formed in the inner lining part and at least a portion of the reflection surface is arranged within the contour of the opening;

wherein at least a portion of the reflection surface is formed by a cover part which covers the opening and with which the insulating foam material is in contact;

wherein the cover part has an edge portion running around the opening; and wherein the module body and the cover part are connected to each other so that a part of the inner lining part is clamped between the edge portion of the cover part and the frame region of the module body.

* * * * *